US006123037A

United States Patent [19]

Shimizu

[11] Patent Number: 6,123,037

[45] Date of Patent: Sep. 26, 2000

[54] MULTI-HEAD EMBROIDERY MACHINE WITH THREAD CUTTING FUNCTION

[75] Inventor: Masaki Shimizu, Toyoake, Japan

[73] Assignee: Brother Kogyo Kabushiki Kaisha, Nagoya, Japan

[21] Appl. No.: 09/275,051

[22] Filed: Mar. 24, 1999

[30] Foreign Application Priority Data

Mar. 24, 1998 [JP] Japan ..... 10-096621

[51] Int. Cl.[7] ..... D05B 21/00; D05B 65/04; D05B 69/36; D05C 9/06

[52] U.S. Cl. ..... 112/102.5; 112/155; 112/273; 112/300; 700/138

[58] Field of Search ..... 112/102.5, 273, 112/278, 155, 300, 316, 317, 470.06, 475.19; 700/138

[56] References Cited

U.S. PATENT DOCUMENTS 5,359,949 11/1994 Asano ..... 112/278 X
5,784,989 7/1998 Shimizu et al. .
5,826,525 10/1998 Hayakawa ..... 112/273 X
5,947,043 9/1999 Morita et al. ..... 112/273 X

FOREIGN PATENT DOCUMENTS 2-68350 3/1990 Japan .
4-307688 10/1992 Japan .
9-290086 11/1997 Japan .

*Primary Examiner*—Peter Nerbun
*Attorney, Agent, or Firm*—Oliff & Berridge, PLC

[57] ABSTRACT

A multi-head embroidery machine includes a plurality of embroidery machines each of which includes thread cutting means, sewing means, thread breakage detecting means, needle bar jumping means and a cloth holder frame, a sewing motor for driving the sewing means of the embroidery machines in common, a frame holder for holding the cloth holder frames of the embroidery machines in common, cloth feeding means for moving the frame holder, stop control means for stopping the sewing motor to interrupt a sewing operation of the sewing means, step-back control means for stepping back via the cloth feeding means the frame holder to an actual or estimated position of occurrence of a thread breakage, re-sewing control means for executing a re-sewing operation approximately to a sewing interruption position in the embroidery machine in which thread breakage has occurred, while the cloth feeding means is being operated, thread-cutting command means for commanding to cut at least one of a needle thread and a bobbin thread on the basis of an amount of step-back of the frame holder by the step-back control means, and re-start control means for re-starting sewing from the sewing interruption position with respect to all the embroidery machines.

27 Claims, 12 Drawing Sheets

MULTI-HEAD EMBROIDERY MACHINE WITH THREAD CUTTING FUNCTION

BACKGROUND OF THE INVENTION

1. Field of the Invention

This invention relates to a multi-head embroidery machine including a plurality of embroidery machines each of which comprises thread cutting means, a thread breakage sensor and a needle bar jumping mechanism.

2. Description of the Related Art

There have conventionally been provided embroidery machines for industrial use for forming the same embroidery pattern on a plurality of pieces of cloth cut into the same configuration or for forming the same embroidery patterns on a plurality of positions of a piece of cloth. For example, Japanese patent publication Nos. 4-307688 and 9-290086 disclose multi-head embroidery machines respectively. Each of the disclosed multi-head embroidery machines comprises a plurality of embroidery machines. Each embroidery machine includes a sewing bed provided with a thread cutting mechanism for simultaneously cutting a needle thread and a bobbin thread. Each embroidery machine also includes a sewing head in which a needle thread jumping mechanism for switching selectively to one of a plurality of needle bars is incorporated in a needle bar casing. Further, the sewing head of each embroidery machine is usually provided with a thread breakage sensor for detecting disconnection of the needle thread. The thread breakage sensor comprises a disc encoder rotated in synchronization with feed of the needle thread every sewing cycle and a photo-interrupter provided to interpose a circumferential edge of the disc encoder and delivering an encoder signal. In this case, disconnection of the needle thread is detected when the encoder signal is not delivered in response to a thread-breakage sensitive stitch number (5 stitches, for example).

The sewing operation is interrupted upon detection of thread breakage by the thread breakage sensor. Further, when the machine is set to an automatic step-back mode, the needle bar jumping mechanisms of all the embroidery machines are operated and a frame holder is automatically stepped back to an estimated position of thread breakage which is a predetermined number of stitches back frog a sewing interruption position.

The thread breakage is usually detected by the thread breakage sensor at a position on the cloth of the thread-breakage sensitive stitch number forward from the actual thread breakage position. Further, the machine is controlled so that the sewing processing is stopped at a sewing interruption position of a stop stitch number (5 stitches, for example) forward from a position of detection of thread breakage. Thus, in the automatic step-back mode, the position of occurrence of the thread breakage is determined to be a position back from the sewing interruption position by the number of stitches equal to addition of the stop stitch number and the thread-breakage sensitive stitch number. The thread breakage in estimated to have actually occurred at the determined position of occurrence of the thread breakage. The frame holder is controlled to be stepped back to the estimated position of occurrence of the thread breakage. Alternatively, the frame holder may be controlled to be stepped back by several stitches (three stitches, for example) so that a part of the cloth where the thread has been broken is concealed.

On the other hand, when the machine is set to a manual step-back mode, a step-back switch is manually operated after the frame holder has stopped at the sewing interruption position. The frame holder of the embroidery machine in which the thread breakage has occurred is stepped back to an actual position of occurrence of thread breakage while the step-back switch is being operated.

In each of the automatic and manual step-back modes, the needle thread is threaded through the sewing needle of the embroidery machine in which the thread breakage has occurred when the frame holder has been stepped back to the position of occurrence of thread breakage. The sewing (re-sewing) is then started. In other words, the needle bar is coupled with the needle bar jumping mechanism being stopped, and the re-sewing is carried out at a low speed from the position of occurrence of thread breakage to the sewing interruption position. At this time, the sewing machine motor is temporarily stopped. The needle thread and the bobbin thread are manually cut regarding each of the embroidery machines wherein no thread breakage occurs. The needle bar jumping mechanisms of the embroidery machines in which no thread breakage has occurred are stopped so that the needle bars are coupled. The sewing is then re-started from the position of sewing interruption wish respect to all the embroidery machines. The needle thread and the bobbin thread are fed by an amount corresponding to a maximum amount of movement of the frame holder when the frame holder is stepped back from the sewing interruption position to the position of occurrence of thread breakage. The manual thread cutting is carried out in the embroidery machines in which no thread breakage has occurred so that the fed thread can be prevented from being bitten into a thread take-up lever and unnecessary thread can be prevented from remaining on the cloth.

In the above-described conventional multi-head embroidery machine, when the thread breaks during the sewing, the frame holder is stepped back from the sewing interruption position to the position of occurrence of thread breakage. Thereafter, the needle thread is threaded through the sewing needle and re-sewing is then carried out at the low speed to the sewing interruption position. The needle thread and the bobbin thread are manually cut after the sewing operation is temporarily stopped. Thereafter, the sewing is re-started from the sewing interruption position. The needle thread and the bobbin thread need not be cut when an amount of step-back is small.

In the conventional multi-head embroidery machine, it takes a lot of time from the re-sewing to the re-start of sewing, that is, a long recovery time from the thread breakage in required. Further, there is a possibility that the needle thread and the bobbin thread are entangled with each other at the time of restarting of the sewing after the thread breakage. Further, in the embroidery machines in which no thread breakage has occurred, the needle thread and the bobbin thread are fed by the amount corresponding to the amount of movement of the frame holder due to step-back. The fed needle and bobbin threads are cut immediately before re-start of the sewing. This results in waste of the thread.

SUMMARY OF THE INVENTION

Therefore, an object of the present invention is to provide a multi-head embroidery machine in which the recovery time from the step-back of the frame holder in the occurrence of thread breakage to the re-start of sewing can be rendered as short as possible, and the waste of the needle and bobbin threads can be restrained.

The present invention provides a multi-head embroidery machine includes a plurality of embroidery machines each of which includes thread cutting means, sewing means, thread breakage detecting means, needle bar jumping means and a cloth holder frame. The multi-head embroidery machine comprises a sewing motor for driving the sewing means of the embroidery machines in common, a frame holder for holding the cloth holder frames of the embroidery machines in common, cloth feeding means for moving the frame holder, stop control means for stopping the sewing motor to interrupt a sewing operation of the sewing means, step-back control means for stepping back via the cloth feeding means the frame holder to an actual or estimated position of occurrence of a thread breakage, re-sewing control means for executing a re-sewing operation approximately to a sewing interruption position in the embroidery machine in which thread breakage has occurred, while the cloth feeding means is being operated, thread-cutting command means for commanding to cut at least one of a needle thread and a bobbin thread on the basis of an amount of step-back of the frame holder by the step-back control means, and re-start control means for re-starting sewing from the sewing interruption position with respect to all the embroidery machines.

According to the above-described multi-head embroidery machine, when the thread breakage has been detected, the sewing machine motor is stopped so that the sewing is interrupted. The frame holder is stepped back to the actual or estimated thread breakage occurrence position. Thereafter, the re-sewing is performed to the sewing interruption position and the sewing is re-started from the sewing interruption position. Since at least one of the needle and bobbin threads is automatically cut by the thread cutting means, the thread breakage recovery processing can be expedited. Further, when the aforesaid thread cutting is performed before execution of the step-back, namely, during interruption of the sewing, the needle and bobbin threads are prevented from being fed upon execution of the step-back. Consequently, the thread can be prevented from being wasted.

In a preferred form, the thread cutting command means determines whether at least one of the needle thread and the bobbin thread is cut, based on the amount of step-back. Further, the thread cutting command means commands the thread cutting means to perform a thread-cutting operation when sewing has been interrupted. Additionally, the thread cutting command means may command the thread cutting means to perform a thread-cutting operation after the re-sewing has been carried out to the sewing interruption position.

In another preferred form, the multi-head embroidery machine further comprises distance computing means for computing a movement distance of the frame holder in a case where the frame holder is stepped back from the sewing interruption position to the thread breakage occurrence position as the amount of step-back. In this arrangement, the thread cutting command means preferably commands the thread cutting means not to perform the thread cutting when the movement distance of the frame holder is below a predetermined value, and the thread cutting command means commands the thread cutting means of at least all the embroidery machines in each of which no thread breakage has occurred, to perform the thread cutting operation when the movement distance of the frame holder is at or above the predetermined value.

In further another preferred form, the multi-head embroidery machine further comprises stitch number competing means for computing, as the amount of step-back, the number of stitches by which the frame holder is stepped back from the sewing interruption position to the thread breakage occurrence position. In this arrangement, the thread cutting command means preferably commands the thread cutting means not to perform the thread cutting when the number of stitches computed by the stitch number computing means is below a predetermined value, and the thread cutting command means commands the thread cutting means of at least all the embroidery machines in each of which no thread breakage has occurred, to perform the thread cutting operation when the computed number of stitches is at or above the predetermined value.

Further, the estimated thread breakage occurrence position preferably corresponds to a position back by a predetermined number of stitches from a detection position where the thread breakage has been detected.

BRIEF DESCRIPTION OF THE DRAWINGS

Other objects, features and advantages of the present invention will become clear upon understanding of the detailed description of the preferred embodiments, made with reference to the accompanying drawings, in which.

DETAILED DESCRIPTION OF THE PREFERRED EMBODIMENTS

A first embodiment of the present invention will be described with reference to FIGS. 1 to 12. The invention is applied to a multi-head embroidery machine provided with three embroidery machines.

Figure 1:
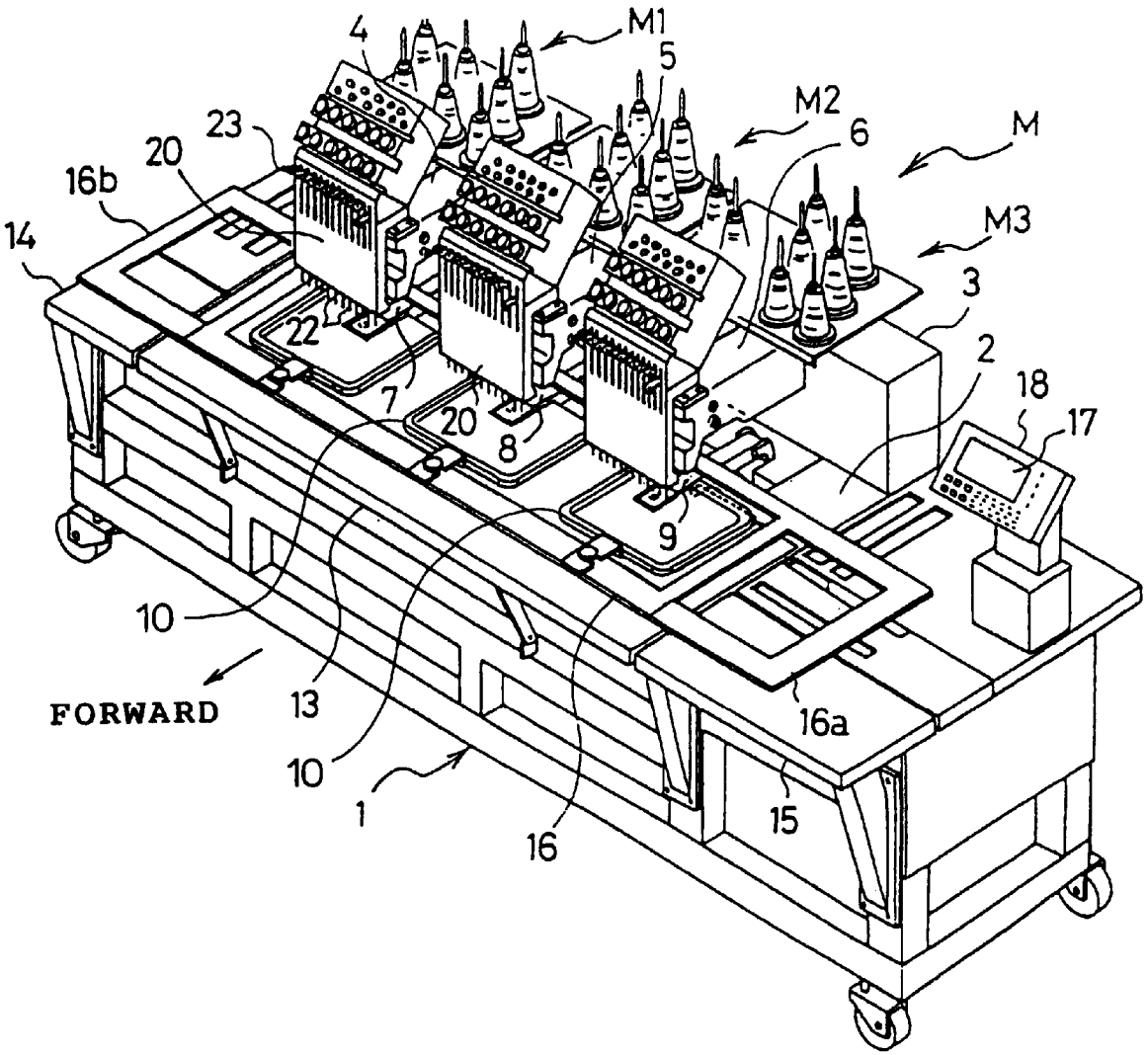
FIG. 1 is a perspective view of a multi-head embroidery machine of a first embodiment in accordance with the present invention.

Referring to FIG. 1, the overall construction of the multi-head embroidery machine M is shown. The multi-head embroidery machine M comprises a laterally extending base frame 1. The base frame 1 has an upper rear surface provided with a laterally extending sewing machine supporting plate 2 having a rectangular shape in a plan view. A laterally extending support frame 3 stands from a rear end of the supporting plate 2. Three head portions 4 to 6 are juxtaposed side by side on the support frame 3 with a predetermined space there between. Three cylindrical bed units 7 to 9 are supported at rear ends thereof on a portion of the base frame 1 located at a front end of the supporting plate 2 so as to correspond to the head portions 4 to 6 respectively.

Thus, the head portions 4 to 6 and the bed units 7 to 9 provided on the support frame 3 constitute three multiple needle type embroidery machines M1 to M3. Needle bar cases 20 are laterally movably mounted on front ends of the embroidery machines M1 to M3 respectively. Twelve laterally aligned needle bars 21 are vertically movably mounted in each needle bar case 20. Further, twelve thread take-up levers 23 are rockably mounted in each needle bar case 20. The needle bar cases 20 are simultaneously moved in the lateral direction by a needle bar changing mechanism (not shown) driven by a needle bar changing motor 84 (see FIG. 6), so that the color of needle threads 11 are concurrently changed from one to another.

A work table 13 is provided in front of the support plate 2 so as to horizontally extend at the same level as upper surfaces of the bed units 7 to 9. A pair of auxiliary tables 14 and 15 are provided at lateral ends of the work table 13 respectively. A laterally extending movable frame 16 having a rectangular shape is mounted on the auxiliary table 14 and 15. The movable frame 16 constitutes a frame holder in the invention. Cloth holding frames 10 corresponding to the respective embroidery machines M1 to M3 are mounted on the movable frame 16. The movable frame 16 includes a right-hand end driving frame portion 16*a* and a left-hand end driving frame portion 16*b*. The right-hand end driving portion 16*a* is moved in the X direction or laterally by an X-axis driving mechanism (not shown). Both of the right-hand end and left-hand end driving portions 16*a* and 16*b* are moved in the Y direction or forward and rearward by a Y-axis driving mechanism (not shown). Accordingly, the movable frame 16 is movable to any position on the X-Y plane. The X-axis driving mechanism is driven by an X-axis driving motor 86 (see FIG. 6) and the Y-axis driving mechanism is driven by a Y-axis driving motor 88 (see FIG. 6). A liquid-crystal display 17 and an operation panel 18 are provided in the rear of the auxiliary table 15. The liquid-crystal display 17 displays messages concerning the embroidery stitching. The operation panel 18 includes various operation switches.

Figure 2:
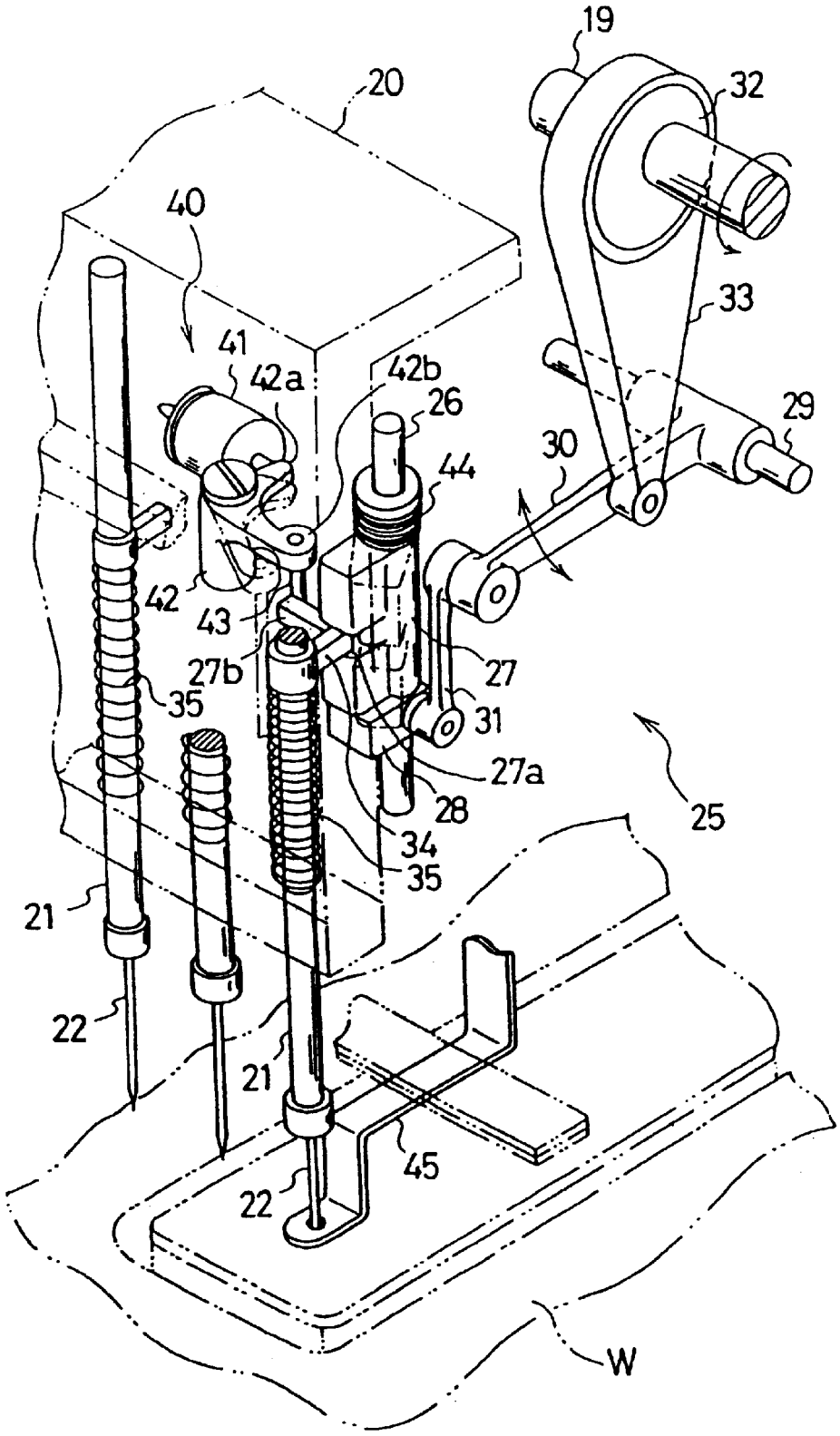
FIG. 2 is a schematic perspective view of a needle bar jumping mechanism and a needle bar vertically driving mechanism.

Referring to FIG. 2, a needle bar driving mechanism 25 is provided on each of the embroidery machines M1 to M3 for vertically moving the needle bars 21. A vertically extending master needle bar 26 is provided at the front end of each of the head portions 4 to 6. Upper and lower ends of the master needle bar 26 is supported on a frame (not shown) of each head portion 4 to 6. A vertically movable member 27 is fitted with the master needle bar 26 for vertical movement. The vertically movable member 27 has an engagement groove 27*a* engaging a linking pin 34 as will be described later. A needle bar connecting bracket 28 is provided on a lower end of the member 27. More specifically, the needle bar connecting bracket 28 is fitted with the master needle bar 26 so as to be vertically movable and non-rotatable. The bracket 28 is connected to a lower end of a link 31. An upper end of the link 31 is connected to a swing lever 30 pivotally supported on a pivot shaft 29.

A single sewing machine spindle 19 extends through the head portions 4 to 6 in the lateral direction. The spindle 19 is driven by a sewing machine motor 80 (see FIG. 6). An eccentric cam 32 is secured to the spindle 19, and an eccentric lever 33 is fitted with the eccentric cam 32. The eccentric lever 33 has a lower end pivotally connected to a middle portion of the swing lever 30.

A sewing needle 22 is secured to the lower end of each of the twelve needle bars 21. A linking pin 34 is secured to an approximately vertically middle portion of each needle bar 21. A compression coil spring 35 is provided around each needle bar 21 so as to be interposed between the linking pin 34 and the support frame of the needle bar case 20. The needle bar 21 is normally urged upward or its upper needle position by the spring 35. The linking pin 34 of the needle bar 21 opposed to the vertically movable member 27 can selectively be engaged with the engagement groove 27*a* of the member 27 when the needle bar case is moved in the lateral direction.

With this arrangement, upon rotation of the sewing machine motor 80 in a predetermined direction, the spindle 19 is rotated so that the member 27 and the bracket 28 are moved together via the eccentric lever 33, the swing lever 30 and the link 31 reciprocally vertically. As a result, only one of the needle bars 21 engaged via the linking pin 34 with the vertically movable member 27 is moved reciprocally vertically in a timed relation with the rotation of the spindle 19.

A needle bar jumping mechanism 40 provided in each of the embroidery machines M1 to M3 will now be described with reference to FIG. 2. The needle bar jumping mechanism 40 in adapted to jump the needle bar 21 to its uppermost position or upper dead point. The needle bar jumping mechanism 40 constitutes needle bar jumping means in the invention. A horizontally extending needle bar jumping solenoid 41 is provided in the needle bar case 20. An angularly movable L-shaped lever 42 is provided in the needle bar case 20 so as to be pivotable about a vertical axis. The L-shaped lever 42 has a driving portion 42*a* which abuts a plunger of the needle bar jumping solenoid 41. The L-shaped lever 42 further has a driven portion 42*b* provided with a vertically extending operation shaft 43 which is engageable with an engagement portion 27*b* integrally protruding from the vertically movable member 27. The member 27 is movable between a normal linking position shown by solid line in FIG. 2 and a jumping position shown by two-dot chain line and spaced away from the connecting position a predetermined angle counterclockwise. The movable member 27 has a torsion coil spring 44 connected to an upper end of the movable member 27 normally urging the member 27 to its linking position.

In the above-described construction, the needle bar jumping solenoid 41 is actuated for a predetermined time to extend its plunger rightward in FIG. 2 when the needle bar 21 is connected via the linking pin 34 to the movable member 27, so that the lever 42 is angularly moved clockwise. Then, the operation shaft 43 pushes the engagement portion 27*b* counterclockwise so that the movable member 27 is concurrently rotated to the jumping position. As a result, the linking pin 34 is disengaged from the engagement groove 27*a*, and at the same time, the compression coil spring 35 promptly coven the needle by 21 to its uppermost position.

On the other hand, when the movable member 27 assuming the linking position is moved upward from its lower position to its uppermost position in a state where the needle bar 21 assumes the uppermost position, the movable member 27 is brought into abutment with the linking pin 34 and temporarily moved to the jumping position. However, the coil spring 44 promptly returns the movable member 27 to the linking position so that the linking pin 34 in automatically engaged with the engagement groove 27*a*.

Each of the bed units 7 to 9 is provided with a presser foot 45. The position of the presser foot 45 can be changed by a presser foot driving mechanism (not shown) between a pressing position where the presser foot presses workpiece cloth W and a retracting position positioned above the pressing position by a predetermined distance. The presser foot driving mechanism is driven by a presser foot driving solenoid 77 (see FIG. 6).

Figure 3:
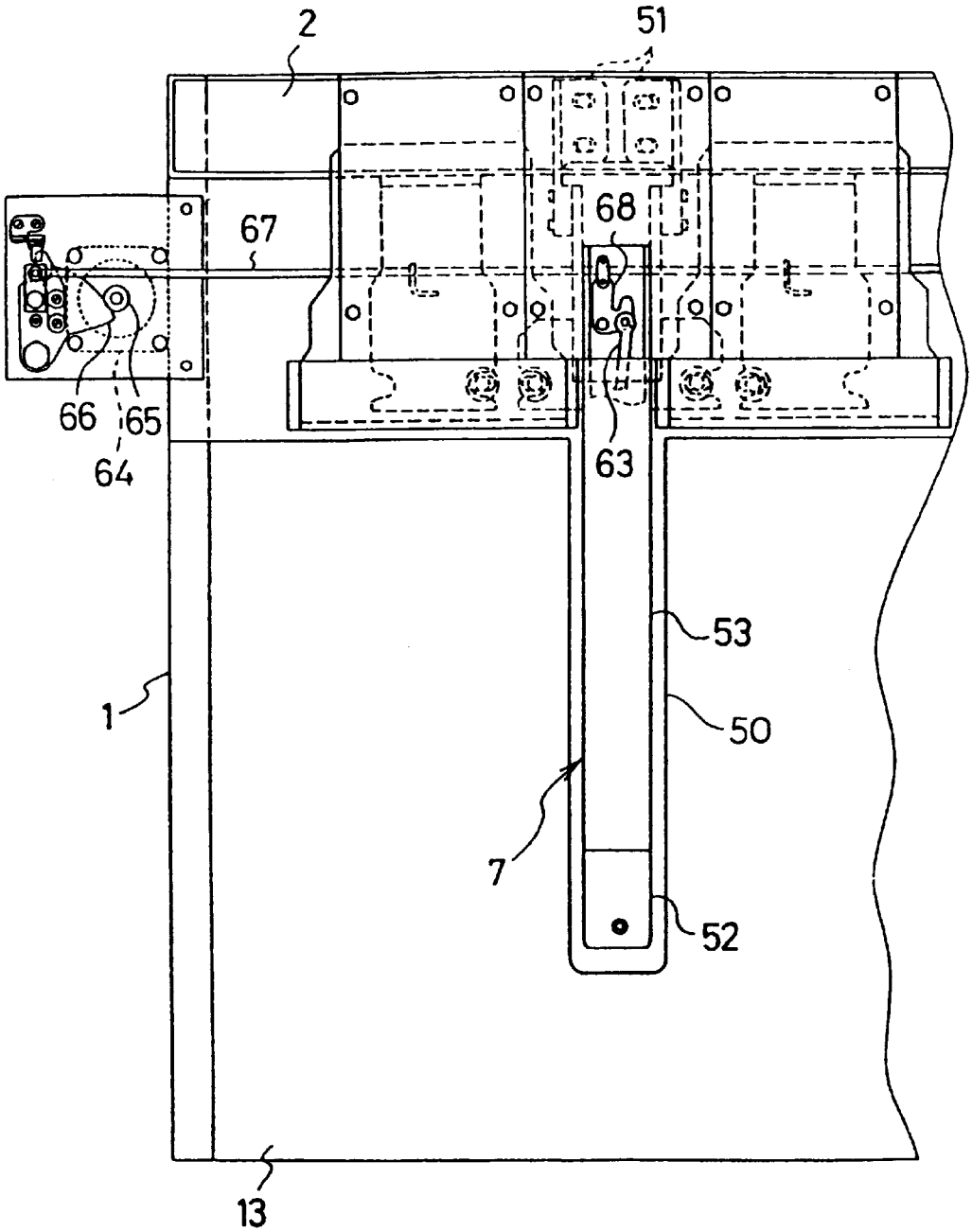
FIG. 3 is a partially enlarged plan view of a work table.
Figure 4:
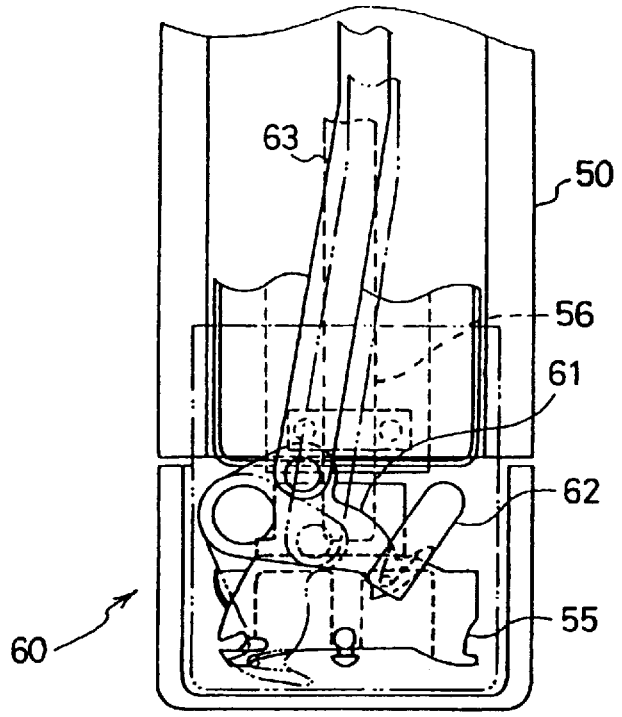
FIG. 4 is a partially enlarged plan view of a bed unit.
Figure 5:
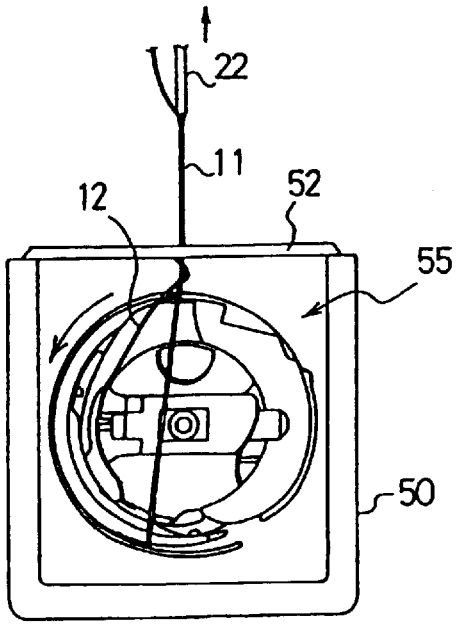
FIG. 5 is a front view of a rotary hook.

The bed units 7 to 9 will now be described with reference to FIGS. 3 to 5. Each bed unit comprises a bed case 50 extending forward and rearward and having a substantially U-shaped section. A rear end of the bed case 50 is mounted to a pair of support brackets 51 secured to the laterally extending base frame 1 located at the front end of the support plate 2. A rotary hook module 55 for trapping a thread loop is provided at a front end of the bed case 50. The rotary hook module 55 is rotated via a hook shaft 56 secured thereto in synchronization with the spindle 19. The bed case 50 has an upper opening, and a front portion of the opening is covered with a throat plate 52. The remaining portion of the opening is covered with a cover plate 53 continuous to the throat plate 52.

A thread cutting mechanism 60 will be described with reference to FIGS. 3 and 4. The thread cutting mechanism 60 is provided in each of the bed units 7 to 9 for cutting the needle thread 11 and the bobbin thread 12. The thread cutting mechanism 60 constitutes thread cutting means in the invention. A movable blade 61 is supported on the backside of the throat plate 52 so as to be pivoted between a standby position shown by solid line in FIG. 4 and a maximum pivot position shown by two-dot chain line. A fixed blade 62 is provided below the throat plate 52 so as to be opposed to an upper side of the movable blade 61. The fixed blade 62 has a blade edge orienting forward for cutting the needle thread 11 and the bobbin thread 12 in cooperation with the movable blade 61. A thread cutting operation lever 63 is pivotally connected to the movable blade 61 extends through the bed case 50 rearward.

A thread cutting motor 64 is provided on the left end of the base frame 1. Upon drive of the thread cutting motor 64, a thread cutting operation shaft 67 is moved rightward and leftward via swinging of a sectorial swinging member 66 in mesh engagement with a driving gear 65 of the motor 64. As a result, when the thread cutting operation lever 63 is moved forward and rearward via a moving plate 68, the movable blade 61 is moved so that the needle and bobbin threads 11 and 12 are simultaneous cut.

Figure 6:
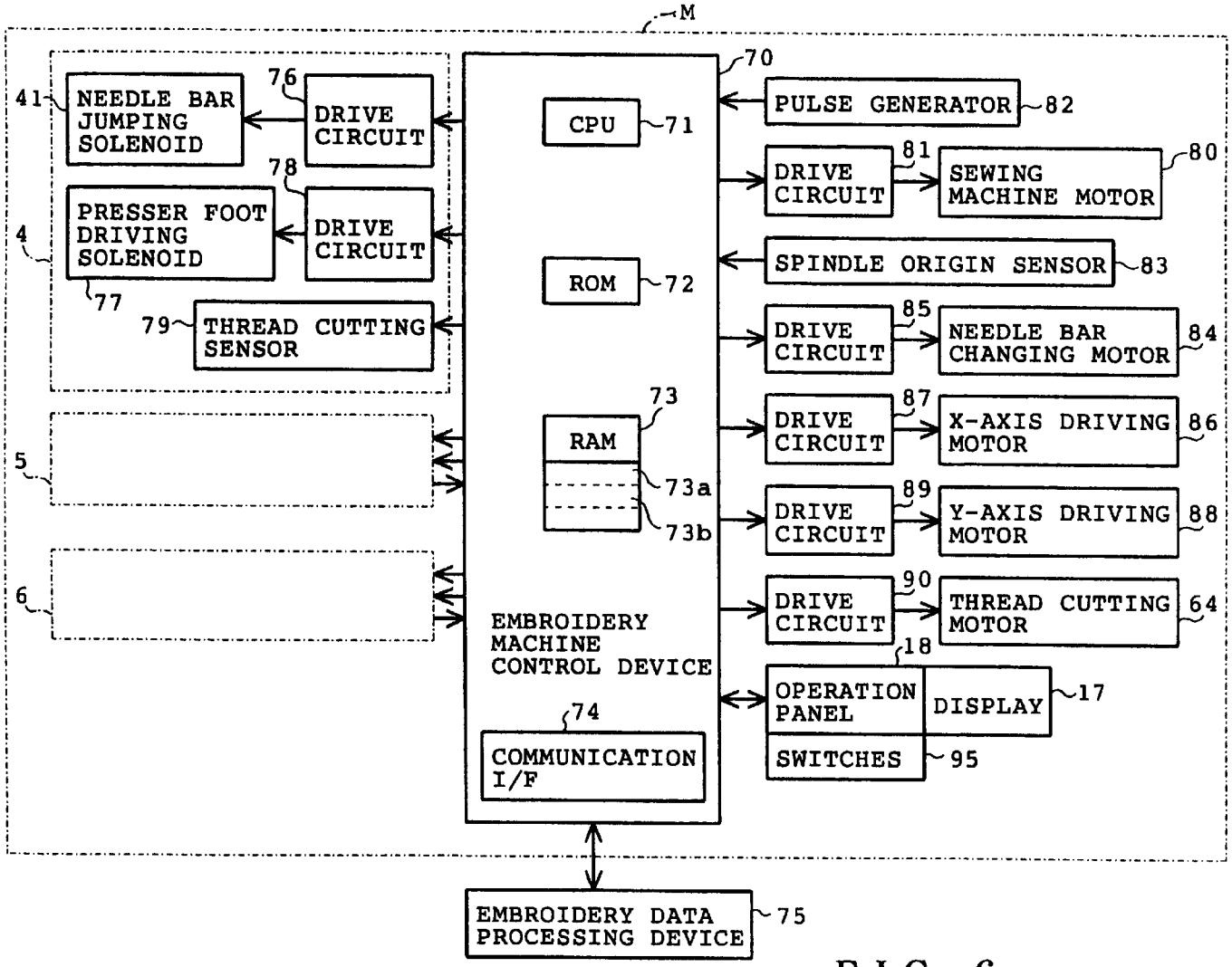
FIG. 6 is a block diagram showing a control system of the multi-head embroidery machine.

A control system of the multi-head embroidery machine M will be described with reference to FIG. 6. A sewing machine control device 70 is provided for controlling an overall operation of the multi-head embroidery machine M. The control device 70 comprises a microcomputer, an input interface (not shown) and an output interface (not shown). Each of the input and output interfaces is connected via a bus such as a data bus to the microcomputer. The microcomputer includes a CPU 71, a ROM 72, a RAM 73 and a communication interface (I/F) 74. The communication I/F 74 is connected to an embroidery data processing device 75 to receive embroidery data transmitted by the latter.

Concerning the head portion 4, two drive circuits 76 and 78 and a thread breakage sensor 79 are connected to the sewing machine control device 70. The drive circuit 76 in provided for driving the needle bar jumping solenoid 41 of the needle bar jumping mechanism 40. The drive circuit 78 is provided for driving a presser foot driving solenoid 77 retracting the presser foot 45. Further, the thread breakage sensor 79 is provided for detecting needle thread breakage and constitutes thread breakage detecting means in the invention. Concerning each of the other head portions 5 and 6, too, the solenoids 41 and 77, the drive circuits 76 and 78, and the thread breakage sensor 79 are connected to the sewing machine control device 70.

Each of the aforesaid thread breakage sensors 79 comprises a disc encoder (not shown) in a path for the needle thread 11 and a photo-interrupter provided to interpose a circumferential edge of the disc encoder and delivering an encoder signal. The disc encoder is rotatably mounted on a frame, and the needle thread 11 is wound on a driving portion of the disc encoder. When the disc encoder is rotated in synchronization with feed of the needle thread 11 every sewing cycle, the photo-interrupter delivers the encoder signal according to rotation of the disc encoder.

A drive circuit 81 for driving the sewing machine motor 80, a pulse generator 82 and a spindle origin sensor 83 are connected to the sewing machine control device 70. Also, a drive circuit 85 for driving a needle bar changing motor 84 and a drive circuit 87 for driving the X-axis driving motor 86 are connected to the control device 70. Further, a drive circuit 89 for driving the Y-axis driving motor 88, a drive circuit 90 for driving the thread cutting motor 64, and the operation panel 18 are connected to the control device 70. The pulse generator 82 delivers the encoder signal including, for example, 1000 pulse signals when the disc encoder provided on the spindle 19 is rotated one turn. The spindle origin sensor 83 delivers a single spindle synchronization signal when the disc encoder is rotated one turn. The operation panel 18 includes a plurality of switches 95 for instructing the start of the sewing and various commands, and a display 17.

The ROM 72 stores control programs for controlling the motors 64, 80, 84, 86 and 88 on the basis of the encoder signal from the pulse generator 82, a spindle synchronization signal from the spindle origin sensor 83, etc. The ROM 72 further stores a control program for executing a sewing control as will be described later. The RAM 73 is further provided with an embroidery data memory 73*a* on which the embroidery data received from the external embroidery data processing device 75, a movement amount memory 73*b* on which data of an amount of movement of the movable frame 16 is stored, and a memory such as a buffer.

Figure 7:
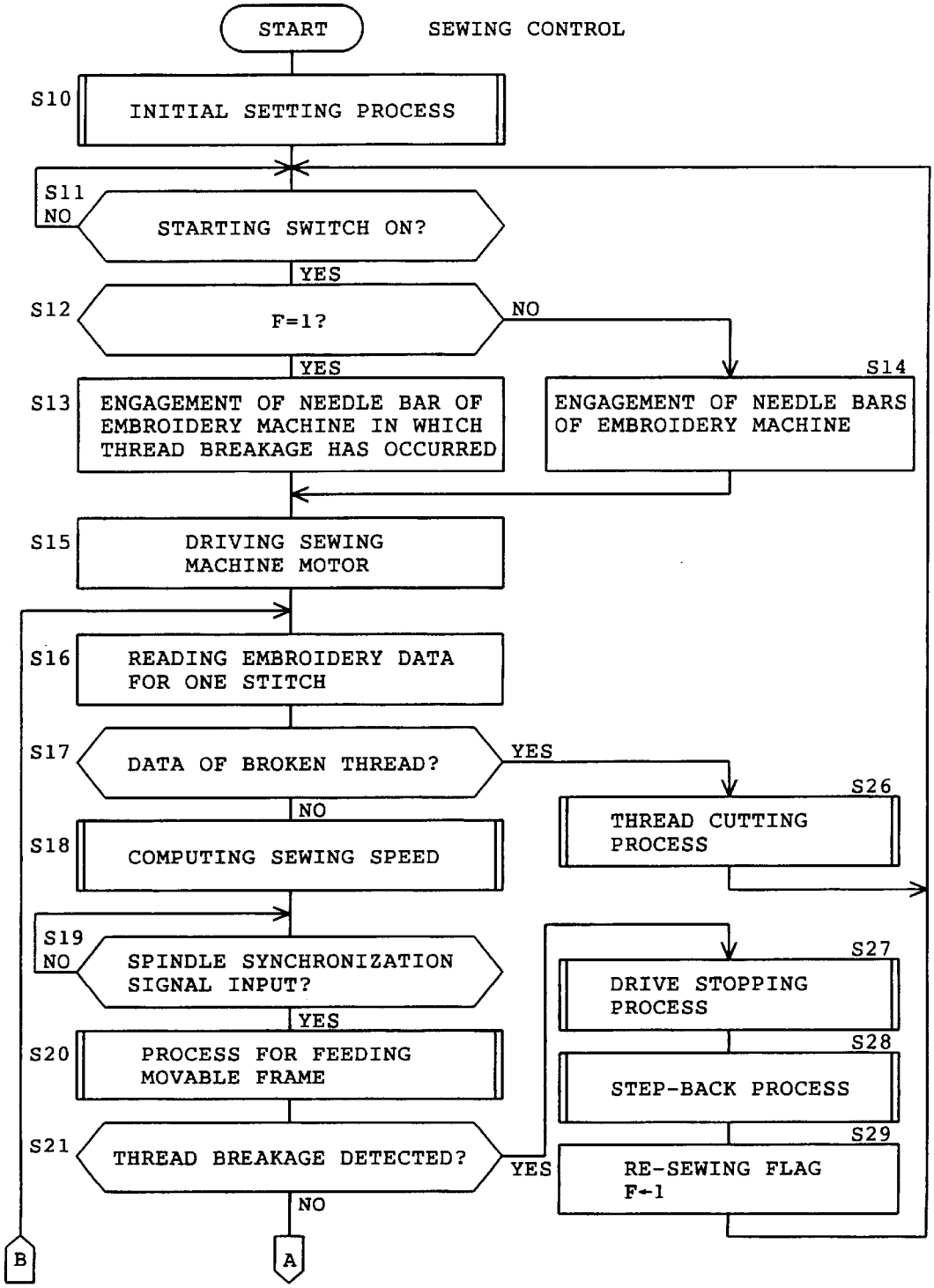
FIG. 7 is a flowchart showing a first half of a sewing control.
Figure 8:
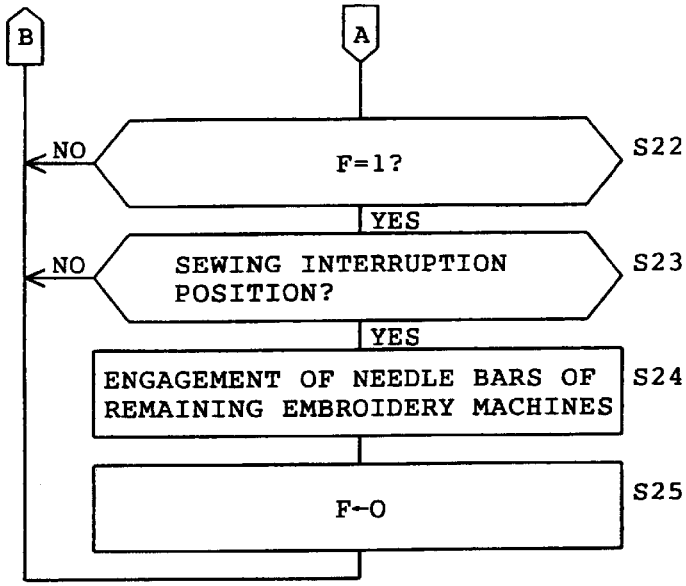
FIG. 8 is also a flowchart showing a second half of the sewing control.
Figure 9:
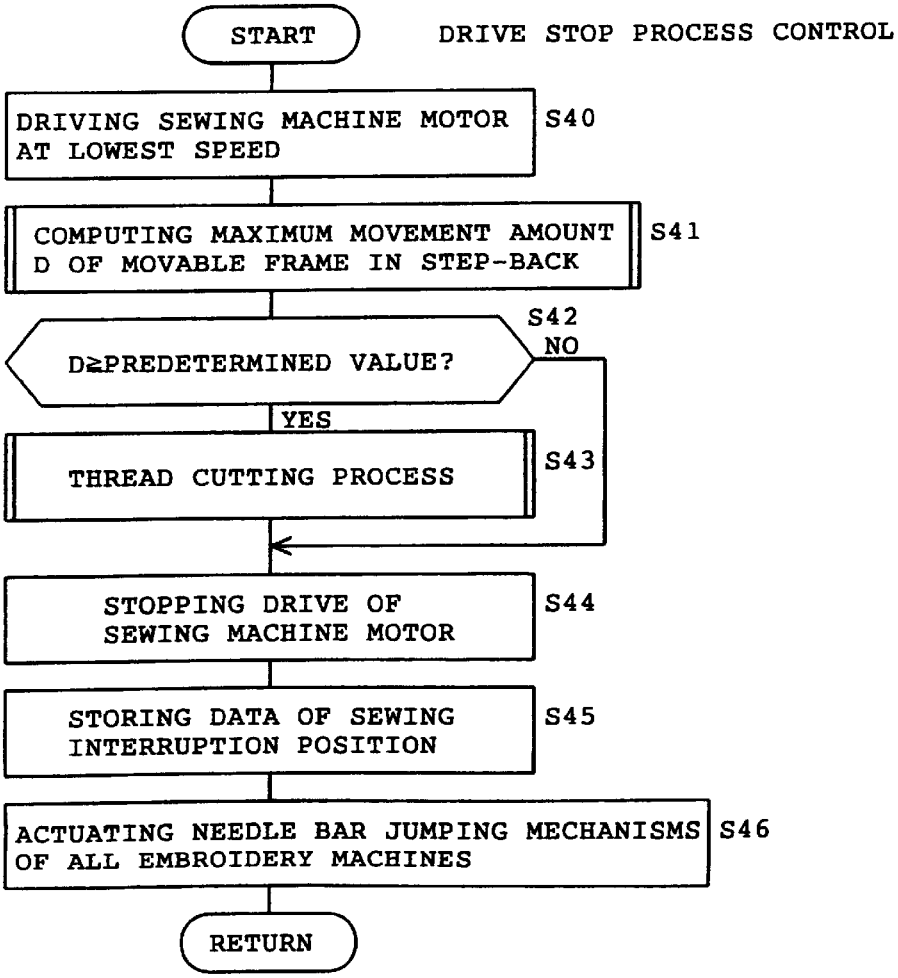
FIG. 9 is a flowchart showing drive stop processing control.

Control contents of the sewing operation executed by the sewing machine control device 70 will be described with reference to FIGS. 7 to 9. It is assumed that the multi-head embroidery machine is set to an automatic step-back mode in the following sewing control. Upon power supply to the embroidery machine M, the control device 70 executes an initializing process including clearing the memories of the RAM 73 (step S10 in FIG. 7). Data transmitted from the embroidery data processing device 75 is stored in the embroidery data memory 73*a* and thereafter, the starting switch provided on the operation panel 18 is turned on so that the sewing process is started (YES at step S11). The control device 70 then advances to step S12 to determine a re-sewing flag F used at the time of thread breakage as will be described later has been set (flag data is "1"). When the re-sewing flag F has not been set (NO at step S12), drive of the needle bar jumping solenoids 41 of the needle bar jumping mechanisms of all the embroidery machines M1 to M3 are stopped, and the needle bars 21 are automatically engaged with the movable member 27 so as to be vertically movable (step S14).

The sewing machine motor 80 is driven (step S15) so that the sewing operation is started in each of the embroidery machines M1 to M3. The control device 70 reads embroidery data for one stitch from the embroidery data memory 73*a* (step S16) and determines whether the read data is thread breakage data (step S17). When the read data is needle position data but not thread breakage data (NO at step S17), the control device 70 obtains drive amounts of the X-axis and Y-axis driving motors 86 and 88, namely, amounts of feed in the X and Y directions, based on the current needle position data and the read needle position data. The control device 70 then computes a sewing speed on the basis of the feed amounts, and the sewing machine motor 80 is driven so that the computed sewing speed is reached (step S18). When the spindle 19 assumes a predetermined rotation position such that the spindle synchronization signal has been input from the spindle origin sensor 83 (YES at step S19), the motors 86 and 88 are driven on the basis of the obtained feed amounts so that the frame holder 10 is moved (step S20), whereby an embroidery frame feeding process is carried out.

When the thread breakage is not detected on the basis of the sensor signal from the thread breakage sensor 79 (NO at step S21) and the re-sewing flag has not been set (NO at step S22 in FIG. 8), the aforesaid steps S16 to S22 are repeated so that the sewing process is executed every stitch. The thread breakage is detected (YES at step S21) when the sensor signals are not input with respect to a predetermined number of stitches, for example, five stitches, from the thread breakage sensor 79. In this case, a drive stopping process control (see FIG. 9) to stop drive of the sewing machine motor 80 is carried out (step S27). Upon start of the drive stopping process control, the sewing machine motor 80 is first driven at a minimum speed (step S40). The control device 70 then advances to step S41 to obtain, by computation, a maximum one D of a plurality of movement distances from a plurality of sewing positions or needle positions to be passed when the movable frame 16 is to be stepped back from a sewing interruption position where the sewing is interrupted to a thread breakage occurrence position which is estimated to a position where the thread breakage has occurred. The estimated thread breakage occurrence position corresponds to a position obtained by returning from the sewing interruption position by the number of stitches obtained by adding a thread-breakage sensitive stitch number to a stop stitch number sewn until the sewing machine motor 80 is stopped. For example, when the thread breakage is detected at a needle position N6 in the midst of the embroidering, a thread breakage occurrence position N1 (Sc) is estimated to be a position obtained by returning from a needle position N11 (S8) where the sewing is interrupted due to the stop of the sewing machine motor 80 through a thread breakage detection position N6 (Sk) back by a stop stitch number (five stitches, for example) and further back by the thread-breakage sensitive stitch number (five stitches, for example). When the movable frame 16 is to be stepped back to the thread breakage occurrence position N1 (Sc), the maximum one D (shown by dot chain line) of a plurality of sewing positions N9 to N1 to be passed is obtained. The needle thread 11 and the bobbin thread 12 are fed according to the maximum movement distance D.

When the maximum movement distance D is at or above a predetermined value, for example, five or six centimeters (YES at step S42), the thread cutting mechanisms 60 of all the embroidery machines in each of which no thread breakage has occurred are actuated to cut the needle thread 11 and the bobbin thread 12 simultaneously (step S43). On the other hand, when the maximum movement distance D is below the predetermined value (NO at step S42), the thread cutting is not carried out in the embroidery machines in each of which no thread breakage has occurred. The drive of the sewing machine motor 80 is then stopped such that the movable frame 16 is stopped at a predetermined sewing interruption position (step S44). Further, data of the sewing interruption position is stored (step S45). Successively, all the embroidery machines M1 to M3 are operated simultaneously so that the needle bars 21 are promptly moved to their uppermost positions respectively (step S46). The control device 70 then finishes the control, returning to step S28 (see FIG. 7) for the sewing control.

Figure 10:
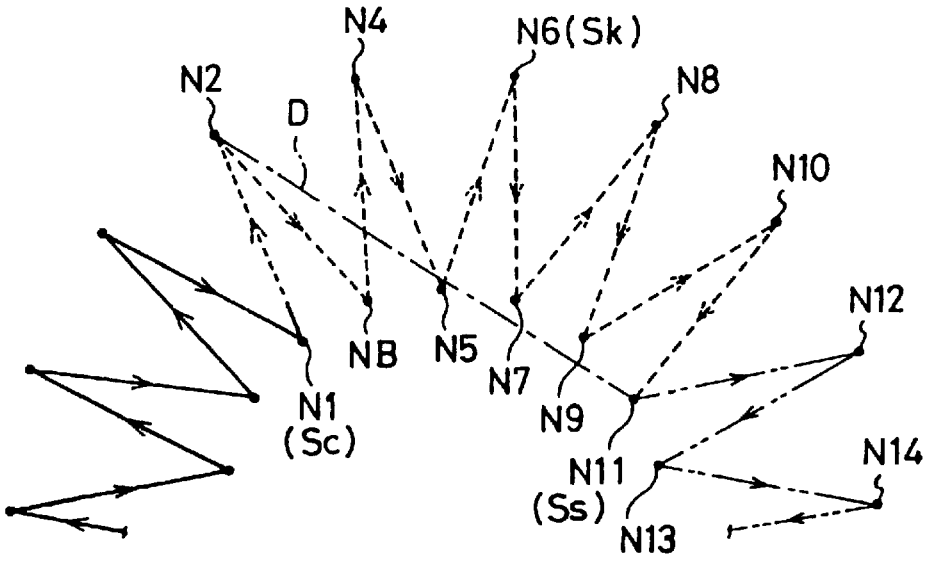
FIG. 10 shows a part of embroidery stitches to explain a maximum movement distance.

A step-back process is executed at step S28. In the step-back process, the movable frame 16 in stepped back or returned from the sewing interruption position through the thread breakage detection position to a needle position corresponding to the thread breakage occurrence position at which the thread breakage is estimated to have occurred. For example, as shown in FIG. 10, the movable frame 16 is stepped back from the sewing interruption position N11 (Ss) through the thread breakage detection position N6 (Sk) to the thread breakage occurrence position N1 (Sc). The re-sewing flag F is then set (step S29). At the time the movable frame 16 is stepped back, the user threads a thread through the sewing needle 22 of the embroidery machine in which the thread breakage has occurred.

Thereafter, the control device 70 determines in the affirmative at step S11 when the starting switch is operated for re-start of the sewing by the user. Since the re-sewing flag F has been set (YES at step S12) in the above-described case, the control device 70 stops the drive of only the needle bar jumping solenoid 41 of the needle bar jumping mechanism 40 of the embroidery machine in which the thread breakage has occurred. As a result, the needle bar 21 of only the embroidery machine in which the thread breakage has occurred is engaged with the movable member 27 so as to be vertically movable (step S13). The sewing machine motor 80 is then driven at a high speed (step S15). Since the re-sewing flag F has been set (YES at step S22), in addition to the aforesaid steps S16 to S22, the control device 70 determines whether the current sewing position is the sewing interruption position (step S23). Thereafter, the steps S16 to S23 are repeated so that the re-sewing is carried out to the sewing interruption position.

When the re-sewing has been executed to the sewing interruption position (YES at step S23), the drive of the needle bar jumping solenoid 41 of each of the other embroidery machines in which no thread breakage has occurred is stopped so that the needle bar 21 is engaged with the movable member 27 so as to be vertically pivotable (step S24). The re-sewing flag F is then reset (step S25), and the step S16 and subsequent steps are executed. Consequently, the sewing operations of all the embroidery machines M1 to M3 re-started from the position where the sewing has been interrupted.

When the read embroidery data is thread breakage data at the aforesaid step S17, the control device 70 determines in the affirmative to advance step S26 where the needle thread 11 and the bobbin thread 12 are simultaneously cut by the thread cutting mechanism 60, and the sewing process is then finished.

According to the above-described embodiment, in a case where the thread breakage has been detected in any one of the embroidery machines M1 to M3 during the sewing such that the sewing has been interrupted, the control device 70 computes the maximum movement distance D of the movable frame 16 when it is to be stepped back from the sewing interruption position to thread breakage occurrence position. When the obtained maximum movement distance D is at or above the predetermined value, the thread cutting is carried out in all the embroidery machines in each of which no thread breakage has occurred and thereafter, the movable frame 16 is stepped back. Accordingly, an excessive amount of feed of the needle and bobbin threads 11 and 12 is not performed when the movable frame 16 in stepped back. Consequently, waste consumption of thread can be prevented. Further, the re-sewing executed after the step-back of the movable frame 16 can be performed at high speeds and accordingly, the thread breakage repair process can be expedited. Additionally, thread can be prevented from remaining on the workpiece cloth or from being loosened unnecessarily on the backside of the cloth.

On the other hand, when the maximum movement distance D of the movable frame 16 is below the predetermined value, the process for cutting needle and bobbin threads 11 and 12 or the thread cutting process is not executed with respect to all the embroidery machines in each of which no thread breakage has occurred. Accordingly, since the movable frame 16 is stepped back without cutting the needle and bobbin threads 11 and 12, the needle and bobbin threads are reliably entangled with each other when the sewing by the embroidery machines in each of which no thread breakage has occurred is re-started. Consequently, the re-sewing after the step-back can be speeded up in addition to an improvement in the quality of sewn products and accordingly, the repair process can be expedited.

Figure 11:
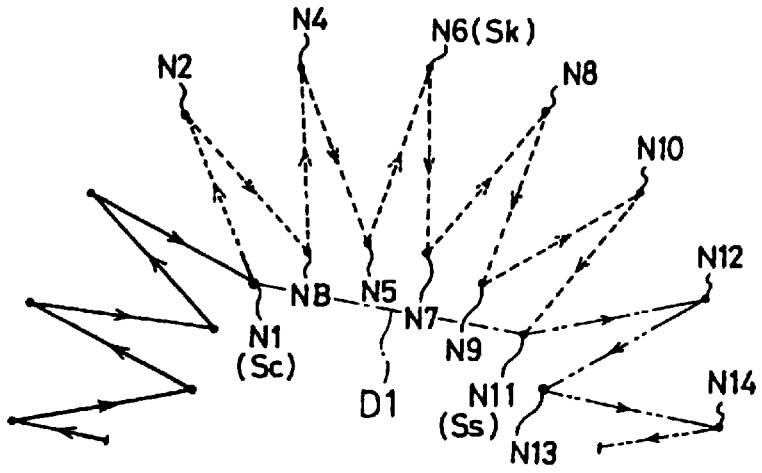
FIG. 11 is a view similar to FIG. 10, explaining a minimize distance to a thread breakage occurrence position.
Figure 12:
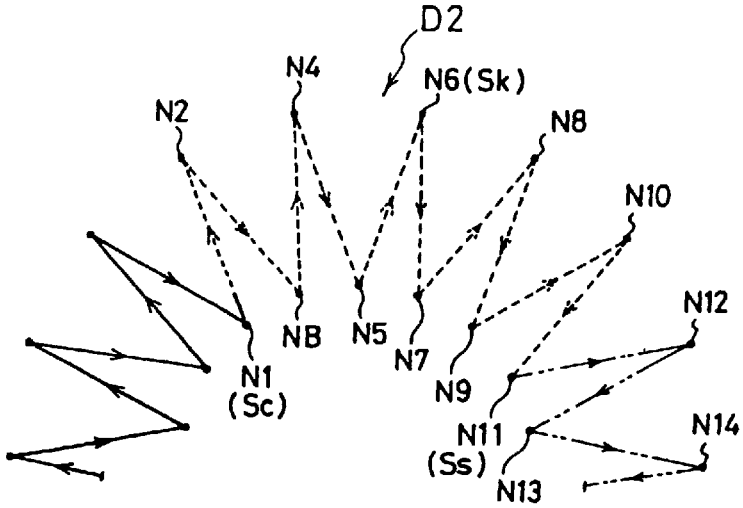
FIG. 12 is a view similar to FIG. 10, explaining a total movement distance to the thread breakage occurrence position.

The maximum movement distance D of the movable frame 16 is obtained by computation at step S41 of the drive stop process control in the foregoing embodiment. However, a minimum movement distance D1 between the sewing interruption position N11 (Ss) and the thread breakage occurrence position N1 (Sc) may be obtained by computation as shown in FIG. 11, instead. Further, a total movement distance D2 from the sewing interruption position N11 (Ss) to the thread breakage occurrence position N1 (Sc) along the stitches may be obtained by computation, namely, the distance D2 is obtained by adding the lengths of all the stitches between the sewing interruption position and the thread breakage occurrence position.

Figure 13:
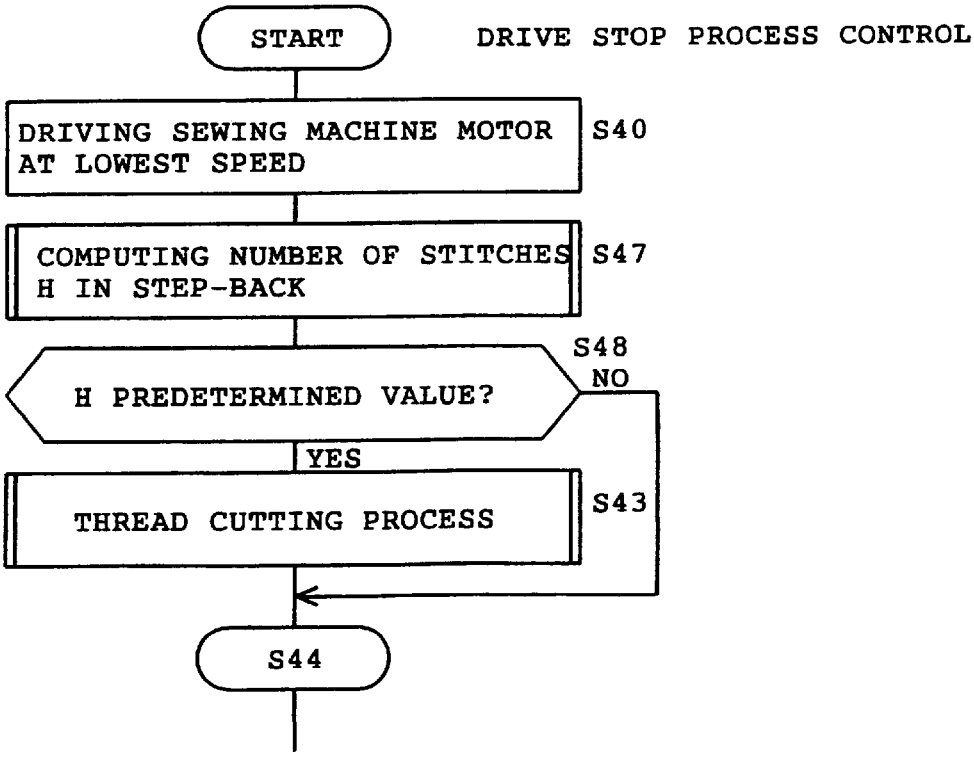
FIG. 13 is a flowchart showing a part of the drive stop processing control in the multi-head embroidery machine of a second embodiment in accordance with the present invention.

FIG. 13 illustrates a second embodiment of the invention. Only the differences between the first and second embodiments will be described. In the drive stop process control shown in FIG. 13, on the basis of the number of stitches H, it is determined whether the thread cutting is performed. More specifically, the sewing machine motor 80 is driven at the lowest speed (step S40 in FIG. 13), and the stitch number H is obtained by computation regarding a case where the movable frame 16 is to be stepped back from the sewing interruption position to the estimated thread breakage occurrence position (step S47). For example, as shown in FIG. 10, the stitch number "10" is obtained regarding a section between a needle position N11 (Ss) where the sewing has been interrupted and the thread breakage occurrence position N1 (Sc) through the thread breakage detection position N6 (Sk). When the stitch number H is at or above a predetermined value, for example, 30 to 50 needles (YES at step S48), the thread cutting mechanism 60 of all the embroidery machines in each of which no thread breakage has occurred are actuated to cut the needle thread 11 and the bobbin thread 12 simultaneously (step S43). On the other hand, when the stitch number H is below the predetermined value (NO at step S48), the thread cutting is not carried out in the embroidery machines in each of which no thread breakage has occurred.

According to the second embodiment, in a case where the thread breakage has been detected in any one of the embroidery machines M1 to M3 during the sewing such that the sewing has been interrupted, the control device 70 computes the stitch number H in the case where the movable frame 16 is to be stepped back from the sewing interruption position to the thread breakage occurrence position. When the obtained stitch number H is at or above the predetermined value, the thread cutting is carried out in all the embroidery machines in each of which no thread breakage has occurred and thereafter, the movable frame 16 is stepped back. Accordingly, an excessive amount of feed of the needle and bobbin threads 11 and 12 is not performed when the movable frame 16 is stepped back. Consequently, waste consumption of thread can be prevented. Further, the re-sewing executed after the step-back of the movable frame 16 can be performed at high speeds and accordingly, the thread breakage repair process can be expedited.

On the other hand, when the stitch number H is below the predetermined value, the process for cutting the needle and bobbin threads 11 and 12 or the thread cutting process is not executed with respect to all the embroidery machines in each of which no thread breakage has occurred. Accordingly, since the movable frame 16 is stepped back without cutting the needle and bobbin threads 11 and 12, the needle and bobbin threads are reliably entangled with each other when the sewing by the embroidery machines in each of which no thread breakage has occurred is re-started. Consequently, the re-sewing after the step-back can be speed up in addition to an improvement in the quality of sewn products and accordingly, the repair process can be expedited.

Figure 14:
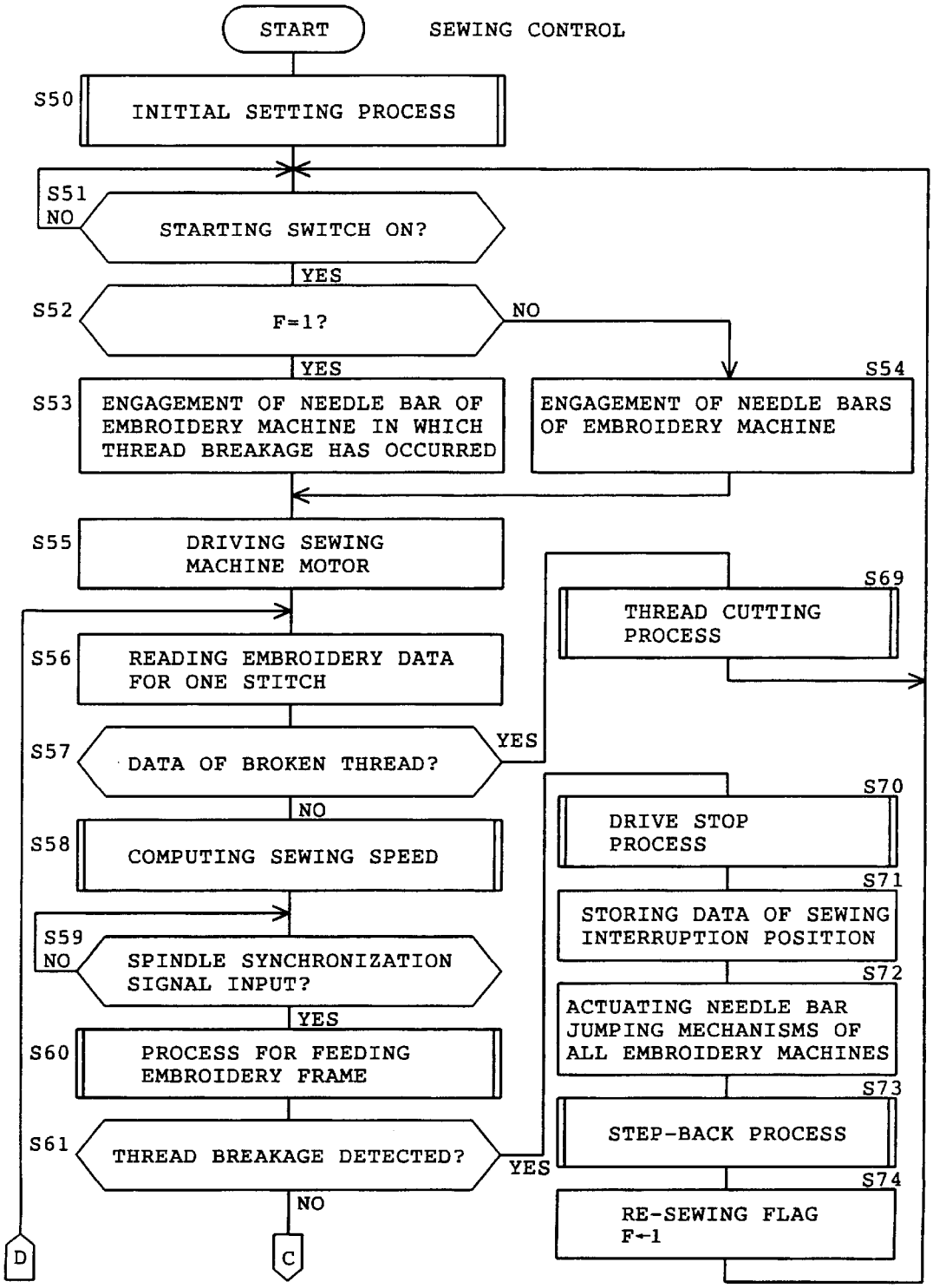
FIG. 14 is a flowchart showing a first half of the sewing control in the multi-head embroidery machine of a third embodiment in accordance with the present invention.
Figure 15:
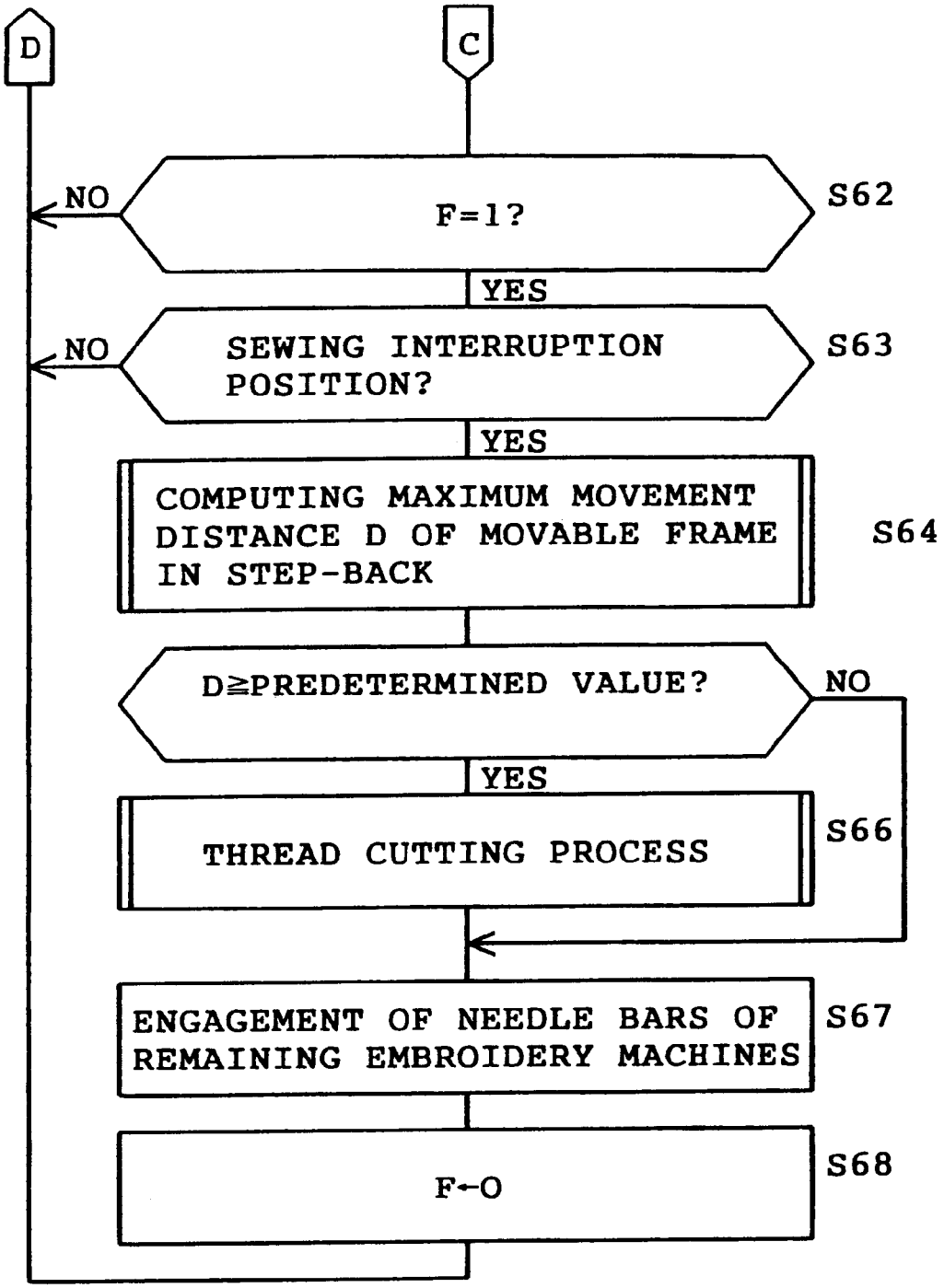
FIG. 15 is a flowchart showing a second half of the sewing control.

FIGS. 14 and 15 illustrate a third embodiment. The differences between the first and third embodiments will be described. In the third embodiment, the re-sewing is performed after the movable frame 16 has been stepped back to the thread breakage occurrence position. The thread cutting is thereafter executed. The other control in the third embodiment is the same as in the first embodiment. More specifically, the control device 70 executes the initializing process (step S50) upon power supply to the embroidery machine M. When the re-sewing flag F has not been set, steps S51, S52, and S54 to S62 are executed in the same manner as the steps S11, S12, and S14 to S22 in the first embodiment, whereupon the sewing process is carried out every one stitch.

When the thread breakage has been detected (YES at step S61), the drive of the sewing machine motor 80 is stopped such that the movable frame is stopped at the sewing interruption position (step S70). Data of the sewing interruption position is stored (step S71). All the embroidery machines M1 to M3 are operated simultaneously so that the needle bars 21 are promptly moved to their uppermost positions respectively (step S72) as in the step S46 in the first embodiment. The movable frame is stepped back from the sewing interruption position through the thread breakage detection position to the thread breakage occurrence position (step S73) as in the step 628, and the re-sewing flag F is set (step S74). The user then threads a thread through the sewing needle 22 of the embroidery machine in which the thread breakage has occurred. The user further operates the starting switch to instruct re-start of the sewing (YES at step S51).

Since the re-sewing flag F gas been set (YES at step S52), the needle bar 21 of the embroidery machine in which the thread breakage has occurred is engaged with the movable member 27 so as to be vertically movable (step S53). The sewing machine motor 80 is then driven at the lowest speed (step S55). Thereafter, the steps S56 to S63 are repeated so that the re-sewing is carried out to the sewing interruption position.

When the re-sewing has been executed to the sewing interruption position (YES at step S63), steps S64 to S66 are executed in the same manner as the steps S41 to 43 in the first embodiment. When the maximum movement distance D of the movable frame 16 is below the predetermined value, the thread cutting is not executed. In this case, step S67 and subsequent steps are executed without the thread cutting, so that the sewing is re-started from the sewing interruption position regarding each of the embroidery machines M1 to M3. On the other hand, when the maximum movement distance D is at or above the predetermined value, the needle and bobbin threads 11 and 12 are simultaneously cut by the thread cutting mechanism 60. Thereafter, step S67 and subsequent steps are executed so that the sewing is re-started from the sewing interruption position regarding each of all the embroidery machines M1 to M3.

On the other hand, when the maximum movement distance D in at or above the predetermined value, the needle and bobbin threads 11 and 12 are simultaneously cut by the thread cutting mechanism 60. Thereafter, steps S67 and subsequent steps are executed so that the sewing is re-started from the sewing interruption position regarding each of all the embroidery machines M1 to M3.

According to the third embodiment, the sewing is interrupted when the thread breakage has been detected in any one of the embroidery machines M1 to M3 during the sewing. The movable frame 16 is stepped back from the sewing interruption position to the thread breakage occurrence position, so that the re-sewing is executed. Thereafter, the control device 70 determines whether the maximum movement distance D of the movable frame 16 is below the predetermined value regarding all the embroidery machines in each of which no thread breakage has occurred. When the maximum movement distance D in below the predetermined value, the sewing is re-started without cutting of the needle and bobbin threads 11 and 12. Consequently, since the needle and bobbin threads 11 and 12 are reliably entangled with each other, the quality of sewn products can be improved.

On the other hand, when the maximum movement distance D is at or above the predetermined value, the thread cutting is performed regarding all the embroidery machines in each of which no thread breakage has occurred. Consequently, the bobbin thread 12 can reliably be prevented from being bitten into the thread take-up lever.

Figure 16:
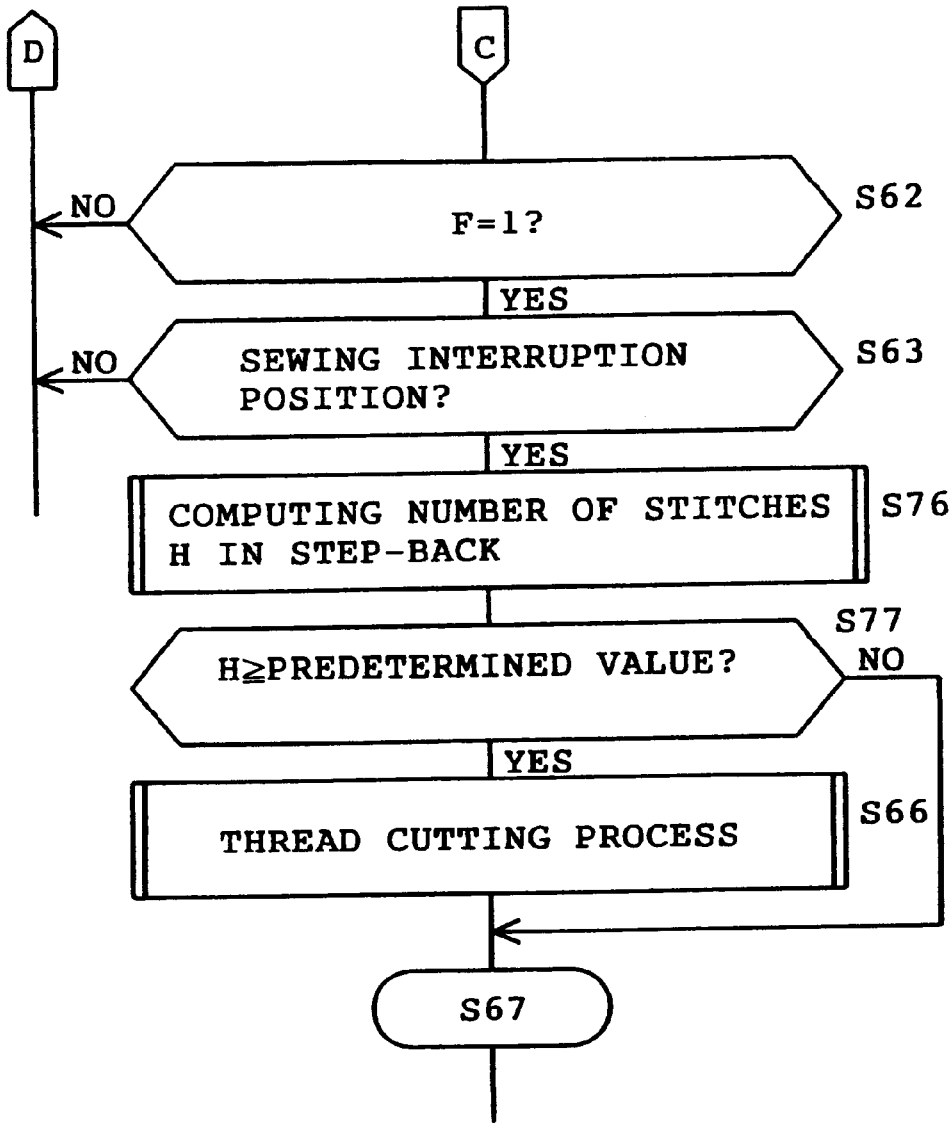
FIG. 16 is a flowchart showing a part of the sewing control in the multi-head embroidery machine of a fourth embodiment in accordance with the present invention.

FIG. 16 illustrates a fourth embodiment of the invention. Only the differences between the third and fourth embodiments will be described. In the fourth embodiment, on the basis of the number of stitches H, it is determined whether the thread cutting is performed. More specifically, when the re-sewing process has been performed to the sewing interruption position (step S62 and YES at step S63 in FIG. 16), the stitch number H is obtained by computation regarding a case where the movable frame 16 is to be stepped back from the sewing interruption position to the estimated thread breakage occurrence position (step S76). When the stitch number H is at or above the predetermined value (YES at step S77), the thread cutting mechanisms 60 of all the embroidery machines in each of which no thread breakage has occurred are actuated to cut the needle thread 11 and the bobbin thread 12 simultaneously (step S66). On the other hand, when the stitch number H is below the predetermined value (NO at step S77), the thread cutting is not carried out in the embroidery machines in each of which no thread breakage has occurred.

According to the fourth embodiment, the sewing is interrupted when the thread breakage has been detected in any one of the embroidery machines M1 to M3 during the sewing. The movable frame 16 is stepped back from the sewing interruption position to the thread breakage occurrence position, so that the re-sewing is executed. Thereafter, the control device 70 determines whether the maximum movement distance D of the movable frame 16 is below the predetermined value regarding all the embroidery machines in each of which no thread breakage has occurred. When the maximum movement distance D is below the predetermined value, the needle and bobbin threads 11 and 12 are not cut. Accordingly, since the needle and bobbin threads 11 and 12 are reliably entangled with each other at the time of re-start of the sewing, the quality of sewn products can be improved. On the other hand, when the maximum movement distance D is at or above the predetermined valuer the thread cutting is performed regarding all the embroidery machines in each of which no thread breakage has occurred. Consequently, the bobbin thread 12 can reliably be prevented from being bitten into the thread take-up lever.

In each of the above-described embodiments, the X-axis driving mechanism and the X-axis driving motor 86 and the Y-axis driving mechanism and the Y-axis driving motor 88 constitute cloth feeding means. The needle bars 21 mounted on the lower end of the respective needles 22 and the rotary hook modules 55 incorporated in the respective bed units 7 to 9 constitute sewing means. Steps S21 and S27 in the sewing control of FIG. 7 constitute stop control means. Step S41 in the drive stop control of FIG. 9 constitutes distance computing means. Steps S42 and S43 in the sewing control of FIG. 7 constitute thread cutting command means. Step 828 in the sewing control constitutes step-back control means. Steps S16 to S23 in the sewing control constitute re-sewing control means. Steps S24 and S25 in the sewing control constitute re-start control means.

Steps S61 and S69 to S72 in the sewing control of FIGS. 14 and 15 constitute step-back control means. Steps S56 to S63 constitute re-sewing control means. Step S64 in the sewing control constitutes distance computing means. Steps S67 and S68 in the sewing control constitute re-start control means.

Further, Step S47 in the drive stop control of FIG. 13 constitutes stitch number computing means. Step S76 in the sewing control of FIG. 16 constitutes stitch number computing means.

Each of the foregoing embodiments may be modified as follows.

First, in each foregoing embodiment, the thread cutting mechanism 60 performs the thread cutting operation for the embroidery machine in each of which thread breakage has occurred as well as the embroidery machines in each of which no thread breakage has occurred when the maximum movement distance D or the stitch number H is at or above the predetermined value. However, a thread-cutting solenoid and motor dedicated to each embroidery machine M1 to M3 may be provided, and whether the thread cutting is performed for every embroidery machine may be selected. Since the thread cutting need not be performed for the embroidery machine in which the thread has been broken, it is preferred not to perform the thread cutting for the embroidery machine in which the thread has been broken.

Second, although the movable frame 16 is stepped back every one stitch in each foregoing embodiment, the movable frame may be stepped back straightforward to the thread breakage occurrence position as disclosed in Japanese unexamined patent publication No. 2-68350 (1990). Thus, any type of step-back manner may be employed.

Third, the stop stitch number between the detection of thread breakage and the stop of sewing and thread-breakage sensitive stitch number may be set to any values respectively. In this case, viewing the display of the operation panel 18, the user preferably operates the operation switches on the operation panel to set these numbers.

Fourth, when the manual step-back mode is set in the sewing control of FIGS. 14 and 15, the movable frame may be moved back one stitch every time a step-back switch provided on the operation panel 18 is operated in the step-back process at step S73.

Fifth, the needle and bobbin threads are simultaneously cut in each of the foregoing embodiments. However, either the needle or bobbin thread may be cut, instead. When the only the needle thread is cut, a thread cutting mechanism disclosed in U.S. Pat. No. 5,784,989 is preferably used. In this case, a consumption of the needle thread can be reduced, and an excessive thread can be prevented from remaining on the workpiece cloth such that the quality of sewn products can be improved. Further, when only the bobbin thread is cut, a consumption of the bobbin thread can be reduced, and the bobbin thread can be prevented from being drawn up to the surface of the cloth.

Sixth, in each foregoing embodiment, the sewing control is executed when the thread breakage has been detected by the thread breakage sensor 79. However, substantially the same control as the above-described sewing control may be executed when the user has stopped the operation of the multi-head embroidery machine M, instead. More specifically, a stop switch 95 serving as stopping means may be provided on the operation panel 18 as shown in FIG. 6. The sewing machine motor is stopped when the stop switch 95 has been operated. Thereafter, the movable frame 16 is manually stepped back by the user. The reason for this forced stop is that thread breakage, if it occurs, cannot sometimes be detected by the thread breakage sensor 79. In such a case, the user operates the stop switch to stop the operation of the multi-head embroidery machine. An amount of step-back may be determined by the user viewing the movable frame 16 moved back to the thread breakage position. When this amount of step-back is obtained by computation of the movement distance or stitch number, substantially the same sewing control as described above can be carried out. The thread cutting may be executed every time the user operates the stop switch so that the step-back is performed. The reason for this is that when the operation of the multi-head embroidery machine has manually been stopped, the distance between the thread breakage occurrence position and the sewing interruption position is often increased.

Seventh, the re-sewing is executed to the sewing interruption position in each foregoing embodiment. However, the re-sewing may be executed slightly ahead the sewing interruption position, instead. That is, the renewing may be executed for a part of the cloth including the sewing interruption position. Further, the sewing re-start position should not be limited to the sewing interruption position. For example, the sewing may be re-started slightly before the sewing interruption position. Thus, the sewing may be re-started from a part of the cloth including at least the sewing interruption position.

Eighth, the control program for execution of the sewing control is stored on the ROM 72 of the sewing machine control device 70 in each foregoing embodiment. However, the control program may be recorded on a recording medium such as a floppy disk or a CD-ROM, instead. In this case, the sewing machine control device 70 may be provided with a reading device for reading data recorded on the recording medium. Further, a flash memory or a hard disc may be provided in the sewing machine control device 70 for storing the control program.

Ninth, the multi-head embroidery machine M may comprise four or more head portions. Further, the aforesaid sewing control is only an example and may be changed or modified.

The foregoing description and drawings are merely illustrative of the principles of the present invention and are not to be construed in a limiting sense. Various changes and modification will become apparent to those of ordinary skill in the art. All such changes and modifications are seen to fall within the scope of the invention as defined by the appended claims.

I claim:

1. A multi-head embroidery machine comprising:

a plurality of embroidery machines each of which includes thread cutting means, sewing means, thread breakage detecting means, needle bar jumping means and a cloth holder frame;

a sewing motor for driving the sewing means of the embroidery machines in common;

a frame holder for holding the cloth holder frames of the embroidery machines in common;

cloth feeding means for moving the frame holder;

stop control means for stopping the sewing motor to interrupt a sewing operation of the sewing means;

step-back control means for stepping back via the cloth feeding means the frame holder to an actual or estimated position of occurrence of a thread breakage;

re-sewing control means for executing a re-sewing operation approximately to a sewing interruption position in the embroidery machine in which thread breakage has occurred, while the cloth feeding means in being operated;

thread-cutting command means for commanding to cut at least one of a needle thread and a bobbin thread on the basis of an amount of step-back of the frame holder by the step-back control means; and re-start control means for re-starting sewing from the sewing interruption position with respect to all the embroidery machines.

2. A multi-head embroidery machine according to claim 1, wherein each embroidery machine includes thread breakage detecting means for detecting thread breakage and the stop control means stops the sewing machine motor when any one of the thread breakage detecting means has detected thread breakage.

3. A multi-head embroidery machine according to claim 1, wherein each embroidery machine includes forced stopping means and the stop control means stops the sewing machine motor on the basis of an instruction from at least one of the forced stopping means.

4. A multi-head embroidery machine according to claim 1, wherein the thread cutting command means determines whether at least one of the needle thread and the bobbin thread is cut, based on the amount of step-back.

5. A multi-head embroidery machine according to claim 4, wherein the thread cutting command means commands the thread cutting means to perform a thread-cutting operation when sewing has been interrupted.

6. A multi-head embroidery machine according to claim 4, wherein the thread cutting command means commands the thread cutting means to perform a thread-cutting operation after the re-sewing has been carried out to the sewing interruption position.

7. A multi-head embroidery machine according to claim 4, further comprising distance computing means for computing a movement distance of the frame holder in a case where the frame holder is stepped back from the sewing interruption position to the thread breakage occurrence position as the amount of step-back.

8. A multi-head embroidery machine according to claim 7, wherein the thread cutting command means commands the thread cutting means not to perform the thread cutting when the movement distance of the frame holder is below a predetermined value, and the thread cutting command means commands the thread cutting means of at least all the embroidery machines in each of which no thread breakage has occurred, to perform the thread cutting operation when the movement distance of the frame holder is at or above the predetermined value.

9. A multi-head embroidery machine according to claim 8, wherein the thread cutting command means commands the thread cutting to perform the thread-cutting operation when sewing has been interrupted.

10. A multi-head embroidery machine according to claim 8, wherein the thread cutting command means commands the thread cutting means to perform the thread-cutting operation after the re-sewing has been carried out to the sewing interruption position.

11. A multi-head embroidery machine according to claim 7, wherein the distance computing means computes, as the movement distance of the frame holder, a maximum one of the movement distances from the sewing interruption position to a plurality of sewing positions having been passed by till the thread breakage occurrence position.

12. A multi-head embroidery machine according to claim 11, wherein the thread cutting command means commands the thread cutting means not to perform the thread cutting when the movement distance of the frame holder is below a predetermined value, and the thread cutting command means commands the thread cutting means of at least all the embroidery machines in each of which no thread breakage has occurred, to perform the thread cutting operation when the movement distance of the frame holder is at or above the predetermined value.

13. A multi-head embroidery machine according to claim 12, wherein the thread cutting command means commands the thread cutting to perform the thread-cutting operation when sewing has been interrupted.

14. A multi-head embroidery machine according to claim 12, wherein the thread cutting command means commands the thread cutting means to perform the thread-cutting operation after the re-sewing has been carried out to the sewing interruption position.

15. A multi-head embroidery machine according to claim 4, further comprising stitch number computing means for computing, as the amount of step-back, the number of stitches by which the frame holder is stepped back from the sewing interruption position to the thread breakage occurrence position.

16. A multi-head embroidery machine according to claim 15, wherein the thread cutting command means commands the thread cutting means not to perform the thread cutting when the number of stitches computed by the stitch number computing means is below a predetermined value, and the thread cutting command means commands the thread cutting means of at least all the embroidery machines in each of which no thread breakage has occurred, to perform the thread cutting operation when the computed number of stitches is at or above the predetermined value.

17. A multi-head embroidery machine according to claim 16, wherein the thread cutting command means commands the thread cutting to perform the thread-cutting operation when sewing has been interrupted.

18. A multi-head embroidery machine according to claim 16, wherein the thread cutting command means commands the thread cutting means to perform the thread-cutting operation after the re-sewing has been carried out to the sewing interruption position.

19. A multi-head embroidery machine according to claim 4, wherein the estimated thread breakage occurrence position corresponds to a position back by a predetermined number of stitches from a detection position where the thread breakage has been detected.

20. A recording medium on which a program for operating a multi-head embroidery machine is recorded, the program realizing the functions of:

stop control means for stopping a sewing motor to interrupt a sewing operation of sewing means;

step-back control means for stepping back via cloth feeding means a frame holder to an actual or estimated position of occurrence of a thread breakage;

re-sewing control means for executing a re-sewing operation approximately to a sewing interruption position in an embroidery machine in which thread breakage has occurred, while cloth feeding means is being operated;

thread-cutting command means for commanding to cut at least one of a needle thread and a bobbin thread on the basis of an amount of step-back of the frame holder by the step-back control means; and re-start control means for re-starting sewing from the sewing interruption position with respect to all the embroidery machines.

21. A recording medium according to claim 20, wherein the stop control means stops the sewing machine motor when any one of the thread breakage detecting means has detected thread breakage.

22. A recording medium according to claim 20, wherein the stop control means stops the sewing machine motor on the basis of an instruction from at least one of the forced stopping means.

23. A recording medium according to claim 20, wherein the thread cutting command means determines whether at least one of the needle thread and the bobbin thread is cut, based on the amount of step-back.

24. A recording medium according to claim 23, wherein the thread cutting command means commands the thread cutting means to perform a thread-cutting operation when sewing has been interrupted.

25. A recording tedium according to claim 23, wherein the thread cutting command means commands the thread cutting means to perform a thread-cutting operation after the re-sewing has been carried out to the sewing interruption position.

26. A recording medium according to claim 23, wherein the program further realizes the function of distance computing means for computing a movement distance of the frame holder in a case where the frame holder is stepped back from the sewing interruption position to the thread breakage occurrence position as the amount of step-back.

27. A recording medium according to claim 23, wherein the program further realizes the function of stitch number computing means for computing, as the amount of step-back, the number of stitches by which the frame holder in stepped back from the sewing interruption position to the thread breakage occurrence position.

* * * * *